United States Patent [19]

Tommis

[11] Patent Number: 4,624,831

[45] Date of Patent: Nov. 25, 1986

[54] COMPOSITIONS OF MATTER AND THEIR MANUFACTURE

[75] Inventor: Norman Tommis, Bradford, England

[73] Assignee: Ae Plc, Warwickshire, England

[21] Appl. No.: 764,615

[22] Filed: Aug. 12, 1985

[30] Foreign Application Priority Data

Aug. 13, 1984 [GB] United Kingdom ..... 8420543

[51] Int. Cl.[4] ..... B22F 3/00

[52] U.S. Cl. ..... 419/20; 75/235; 148/126.1; 148/127; 419/24; 420/552; 501/103; 501/105

[58] Field of Search ..... 419/19, 20, 24; 75/235; 420/552; 501/103, 105; 148/126.1, 127

[56] References Cited

U.S. PATENT DOCUMENTS 3,625,676 12/1971 Perfect ..... 420/252

3,728,108 4/1973 Sifferlen et al. ..... 420/252

*Primary Examiner*—Stephen J. Lechert, Jr.

*Attorney, Agent, or Firm*—Leydig, Voit & Mayer, Ltd.

[57] ABSTRACT

A composition of matter comprises aluminium or aluminium alloy, such as LM 13, into which has been incorporated between 5 and 50% by volume of zirconia. The zirconia may be in the form of fibres or of powder. As compared with the aluminium alloy, this reduces the thermal conductivity and coefficient of expansion, and provides a material which has, particularly at elevated temperatures above 300° C., improved tensile strength, compressive strength, and hardness and reduced elongation.

7 Claims, 13 Drawing Figures

COMPOSITIONS OF MATTER AND THEIR MANUFACTURE

BACKGROUND TO THE INVENTION

The invention relates to a composition of matter and its manufacture.

SUMMARY OF THE INVENTION

According to a first aspect of the invention, there is provided a composition of matter comprising aluminium or an aluminium alloy, into which has been incorporated between 5% and 50% by volume of zirconia.

According to a second aspect of the invention, there is provided a method of manufacturing a composition of matter according to the first aspect of the invention, and comprising preparing molten aluminium or a molten aluminium alloy, then incorporating thereinto zirconia in an amount of from 5% to 50% by volume and then solidifying the matter so produced.

BRIEF DESCRIPTION OF THE DRAWINGS

The following is a more detailed description of some embodiments of the invention, by way of example, reference being made to the accompanying drawings, in which.

DESCRIPTION OF THE PREFERRED EMBODIMENTS

Figure 1:
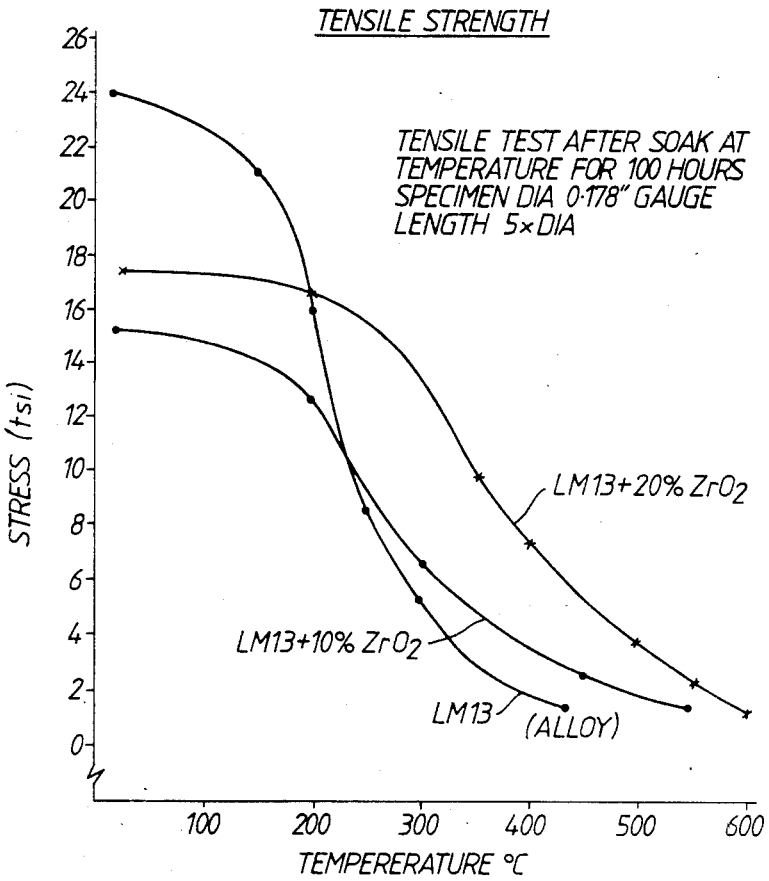
FIG. 1 is a graph of the variation of tensile strength (in tons per square inch) against temperature (in °C.) for three materials: an aluminium alloy known as LM 13, LM 13 reinforced by 10% of zirconium oxide and LM 13 plus 20% of zirconium oxide.

A material is prepared in the following way:

EXAMPLE 1

Zirconia fibres, partly stabilized by yttria, and having an aspect ratio of from 50 to 1000 and a diameter from 2 to 20 micrometers are formed into a wad by compaction. A binder may be included to hold the fibres together. The compaction is such as to provide a required volume of zirconia in the finished material. This volume may be from 5% to 50% but is preferably from 10 to 30%, for example 20%.

The wad or mat is then inserted into a closed die and a molten aluminium alloy is gravity fed into the die. This aluminium alloy may be that known as Lo-Ex or that in accordance with BS.1490:1970:LM 13 and known as LM 13. The molten aluminium alloy may be solidified under a force of many tonnes by a method known as squeeze casting, to cause the molten aluminium alloy to penetrate fully the wad or mat of fibres.

The material so produced is then solidified, heat treated by a solution treatment and aged. The thermal conductivity, coefficient of thermal expansion and density of the material prepared as described above with 20% by volume of zirconia fibres, and a comparison of such properties with the corresponding properties of the aluminium alloy by itself, grey cast iron and austenitic cast iron are given in the following Tables I, II and III.

TABLE I

| COMPARISON OF THERMAL CONDUCTIVITIES (20-200° C.) | | |
|---|---|---|
| | (CALS/SO CM/CM/SEC) | (W/MK) |
| LM 13 Alloy | 0.04 | 140 |
| LM 13 + 20% Zirconia Fibres | 0.22 | 63 |
| Grey Cast Iron | 0.13 | 37 |
| Austenitic Cast Iron | 0.11 | 31 |

TABLE II

| COMPARISON OF COEFFICIENTS OF THERMAL EXPANSIONS (X $10^{-6}$/°C.) | | | |
|---|---|---|---|
| | 20-100° C. | 20-200° C. | 20-300° C. |
| LM 13 Alloy | 19.0 | 19.5 | 20.0 |
| LM L3 + 20% Zirconia | 14.0 | 16.0 | 17.7 |
| Grey Cast Iron | 11.0 | 11.7 | 12.2 |
| Austenitic Cast Iron | 19.0 | 19.0 | 19.0 |

TABLE III

| COMPARISON OF DENSITIES (GMS/CC) | |
|---|---|
| LM 13 Alloy | 2.70 |
| LM L3 + 20% Zirconia Fibres | 3.42 |
| Grey Cast Iron | 7.2 |
| Austenitic Cast Iron | 7.6 |

The effect of the zirconia content on the coefficient of expansion of a material prepared as described above is given in Table IV. The percentage figures of zirconia are by volume.

TABLE IV

| EFFECT OF ZIRCONIA CONTENT ON COEFFICIENT OF THERMAL EXPANSION (X $10^{-6}$/°C.) | | | |
|---|---|---|---|
| | 20-100° C. | 20-200° C. | 20-300° C. |
| LM 13 + 10% Zirconia | 16.7 | 16.7 | 17.7 |
| LM 13 + 20% Zirconia | 14.0 | 16.0 | 17.7 |
| LM 13 + 25% Zirconia | 13.5 | 13.7 | 17.0 |

Referring next to the drawings, FIGS. 1, 2, 3 and 4 show the variation with temperature of, respectively, tensile strength, elongation, compression and hardness for three materials; the aluminium alloy used in Example 1, the aluminium alloy including 10% of zirconia fibres prepared as described above with reference to Example 1 and the aluminium alloy including 20% of zirconia fibres prepared as described above with reference to Example 1. Tensile strength tests were performed on a specimen of diameter 0.178 inches gauge, with a length five times the diameter and after soaking the specimen for a 100 hours at the test temperature. The elongation tests were performed on a similar specimen and after similar heat soaking. The compression tests show the 0.1% compression stress on a specimen 0.375 inches in diameter and 0.375 inches long, after soaking the specimen at the test temperature for 100 hours. The hardness test was a Brinell hardness test HB2.40 on the ends of the specimens used for the tensile strength tests.

It will be seen from these Tables and from the Figures that the thermal conductivity of a material prepared as described above in Example 1 is much less than that of the aluminium alloy itself and approaches the thermal conductivity of grey cast iron and austenitic cast iron. From Table II, it can be seen that the coefficient of thermal expansion of this material is similarly reduced in comparison with that of the aluminium alloy itself and, once again, approaches the values of this property for grey cast iron and austenitic cast iron. The density of such a material is somewhat higher than the density of the aluminium alloy itself but is still substantially less than that of grey cast iron and austenitic cast iron.

Table IV shows that a reduction in the coefficient of thermal expansion of the material can be obtained by increasing the percentage of zirconia but that the effect is less marked as the temperature range is broadened.

Figure 2:
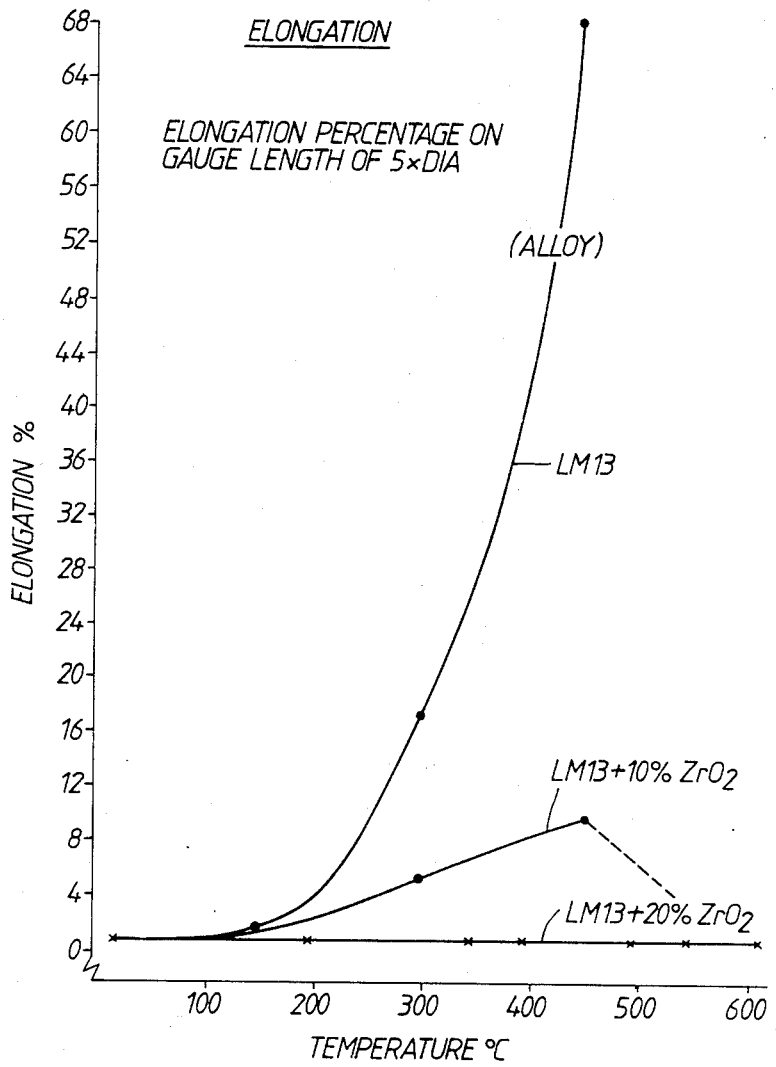
FIG. 2 is a graph of elongation (in percent) against temperature (in °C.) of the three materials of FIG. 1.

FIG. 1 shows that although the tensile strength of materials prepared as described above are less than the strength of the aluminium alloy itself at temperatures below about 200° C., above such temperatures these materials show a significant increase in tensile strength. FIG. 2 shows that materials prepared as described above have, above 200° C., very substantially reduced elongation in comparison with the aluminium alloy itself and that, indeed, the elongation of the material prepared as described above with 20% by volume of zirconia remains substantially constant even at temperatures of 600° C. and above.

Figure 3:
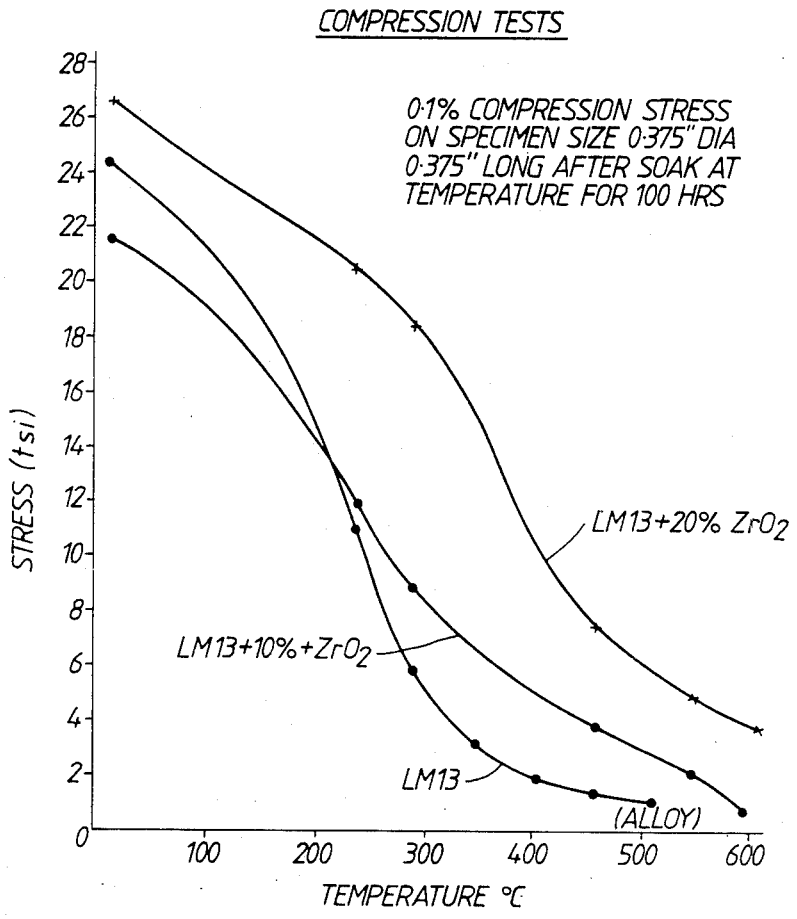
FIG. 3 is a graph of compressive strength (in tons per square inch) against temperature (in °C.) of the three materials of FIGS. 1 and 2.
Figure 4:
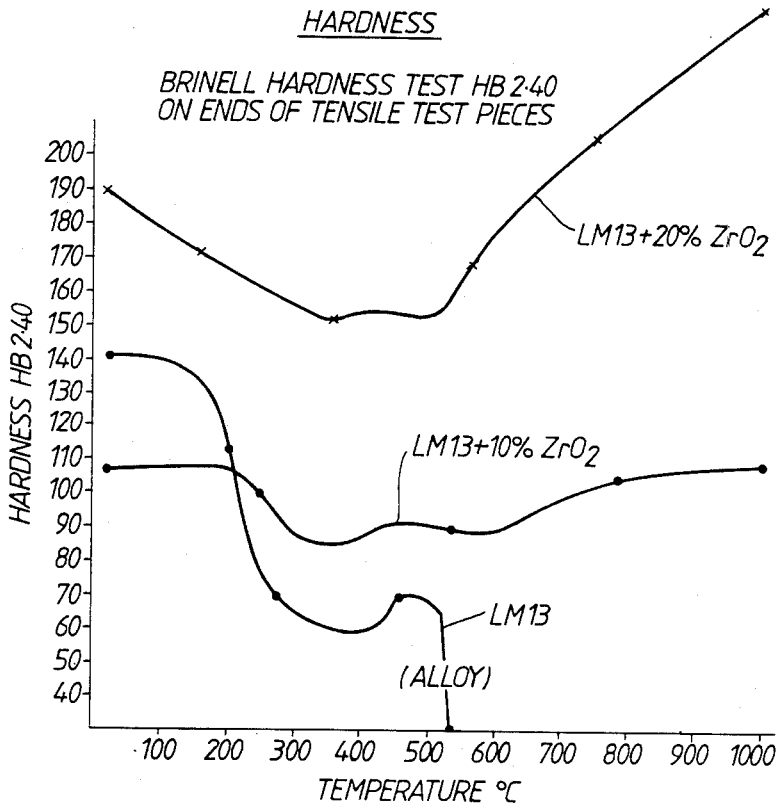
FIG. 4 is a graph of hardness (Brinell hardness test HB2.40) against temperature (in °C.) of the three three materials of FIGS. 1, 2 and 3, FIGS. 5 to 13 are photomicrographs of an aluminium alloy known as LM 13 including 20% by volume of zirconia, at a magnification of 500 and at temperatures of 20° C., 200° C., 350° C., 400° C., 500° C., 550° C., 600° C., 850° C. and 950° C. respectively.
Figure 5:
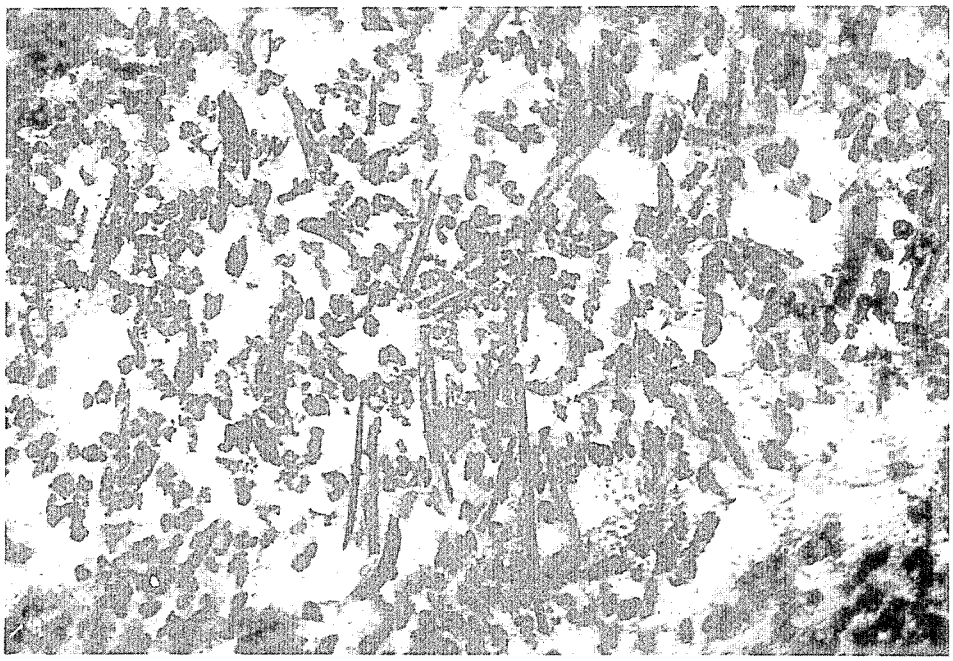
Figure 6:
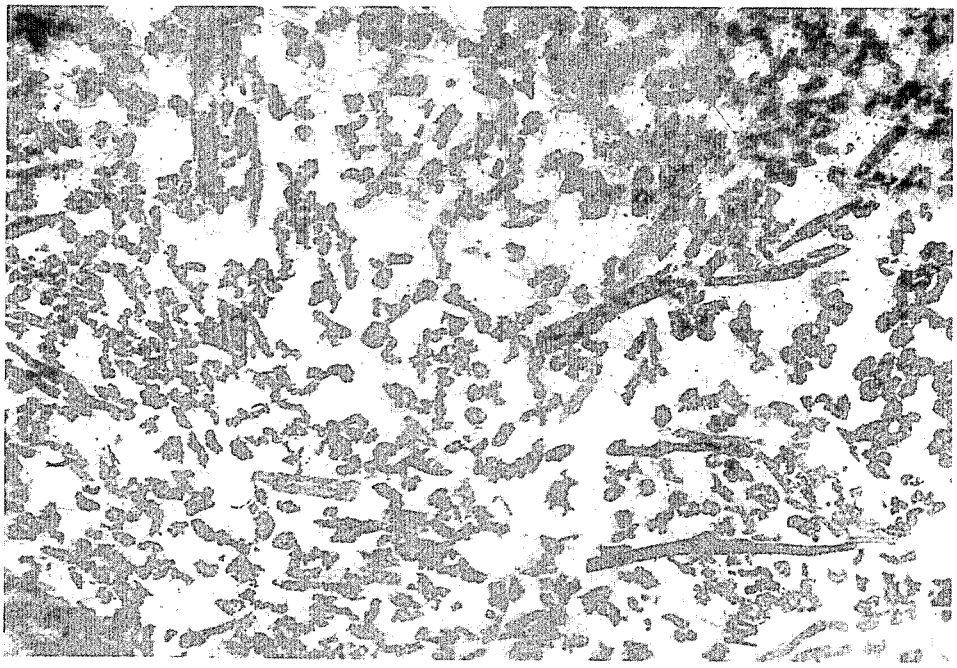
Figure 7:
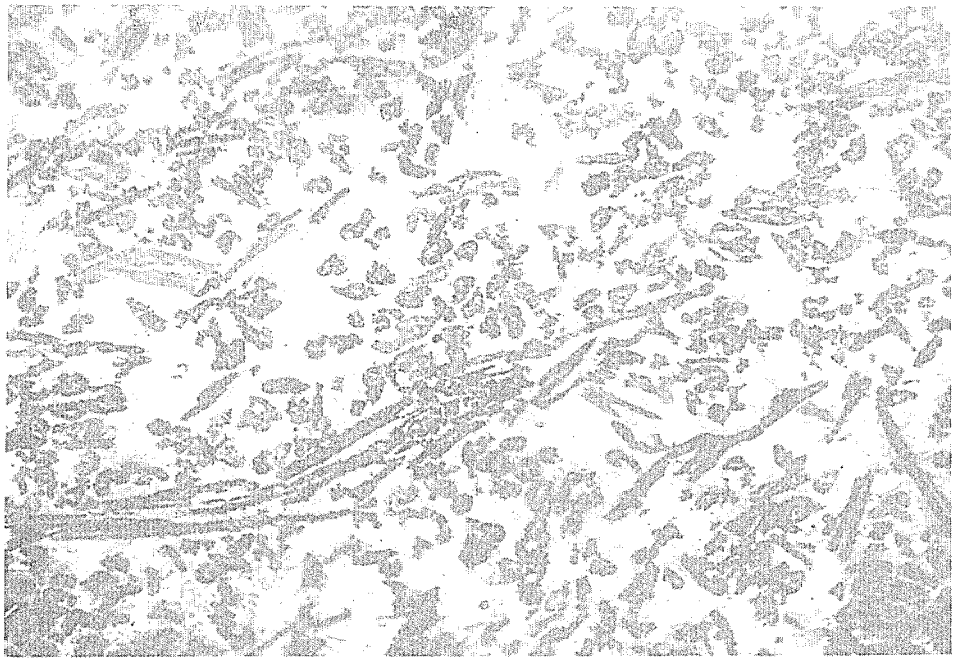
Figure 8:
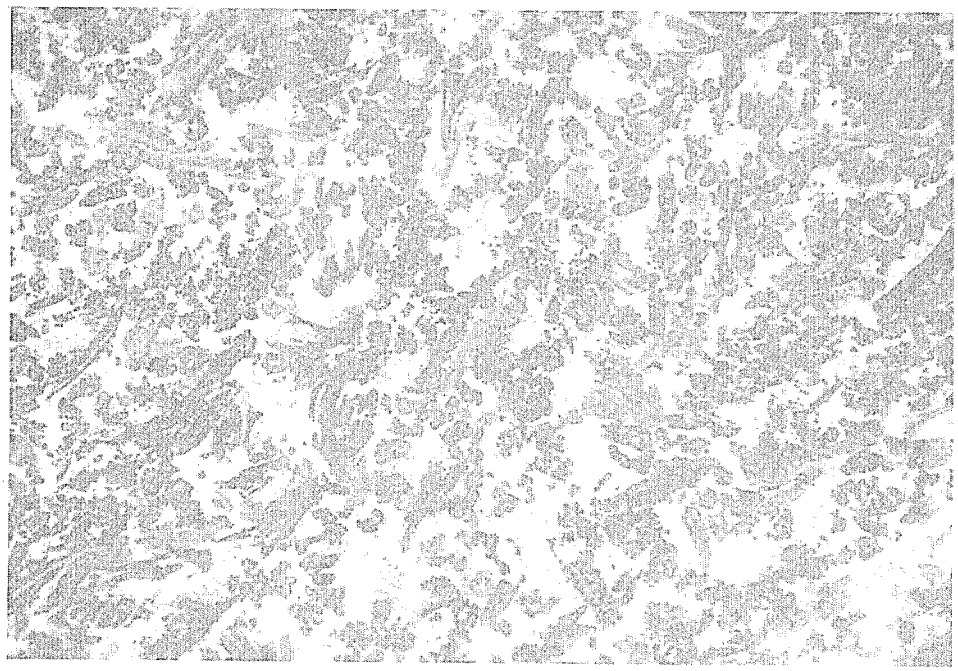
Figure 9:
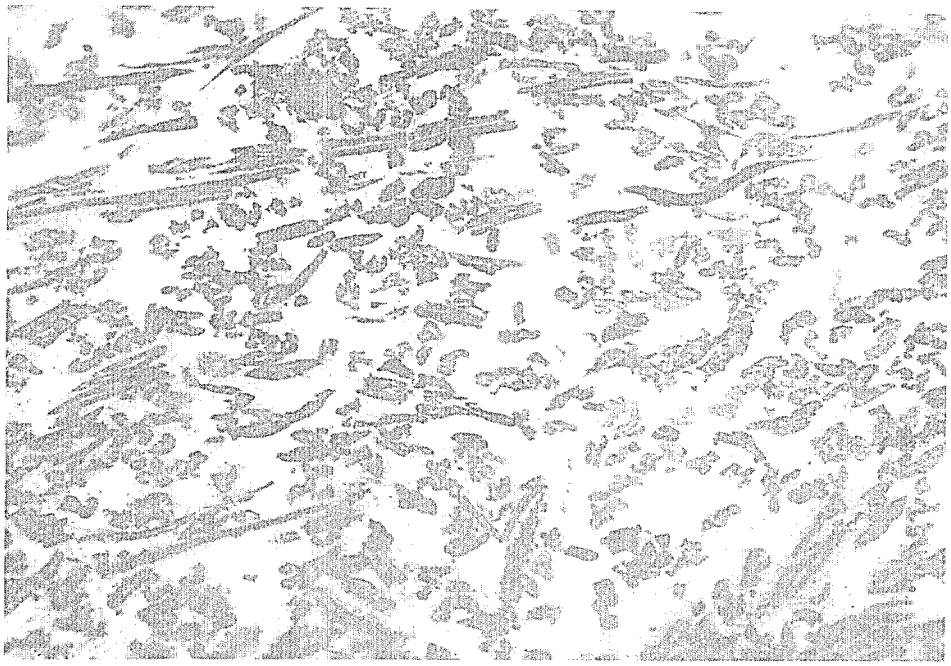
Figure 10:
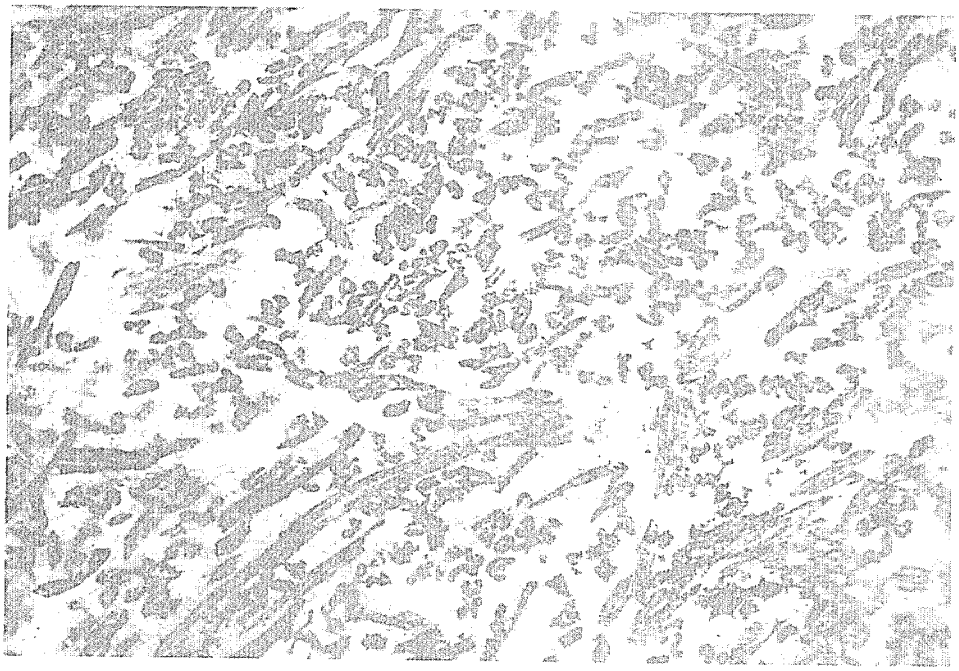
Figure 11:
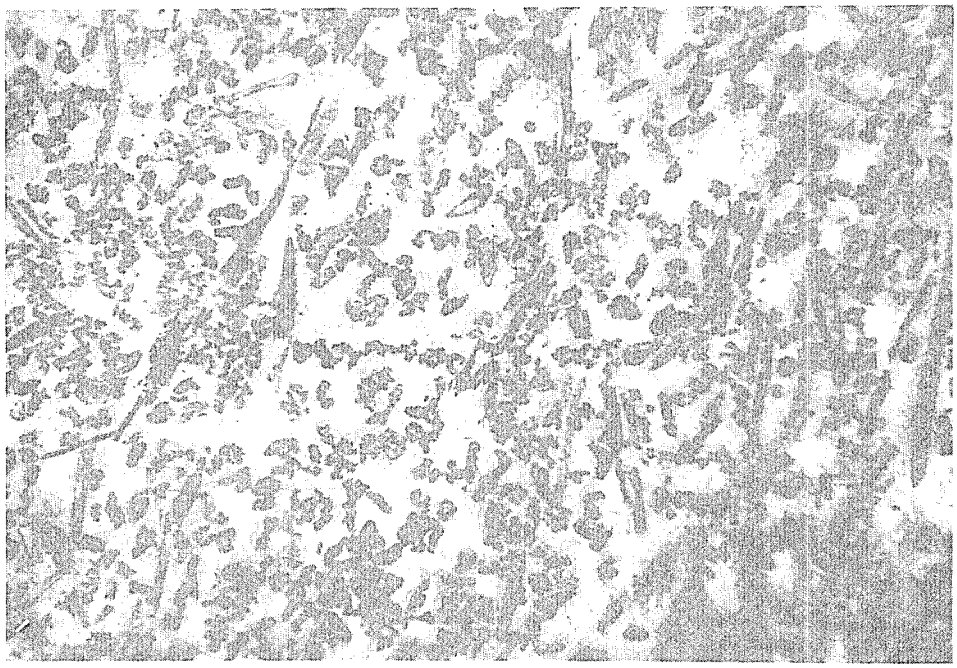
Figure 12:
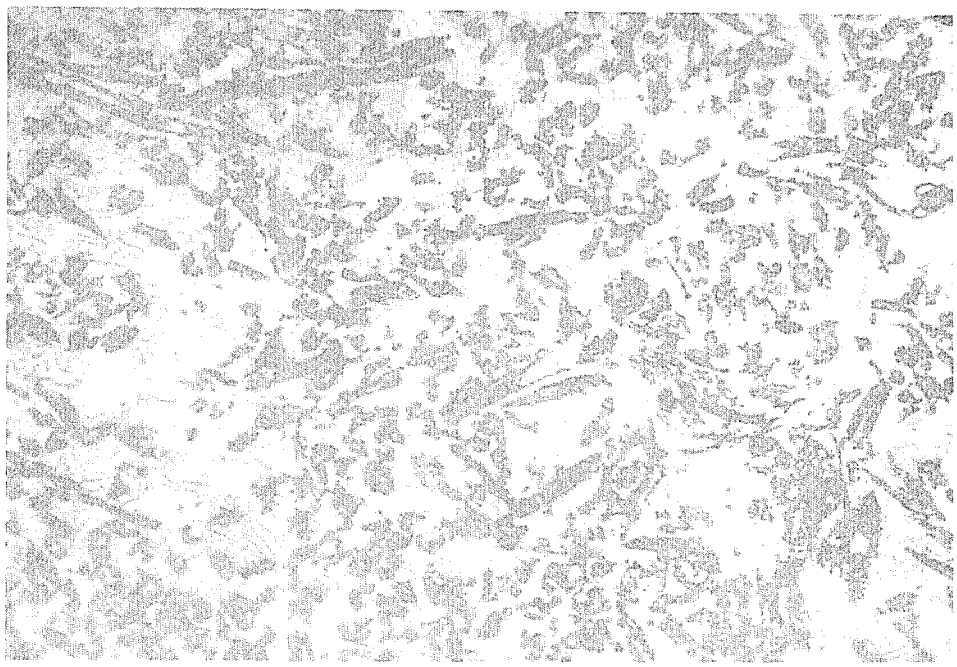
Figure 13:
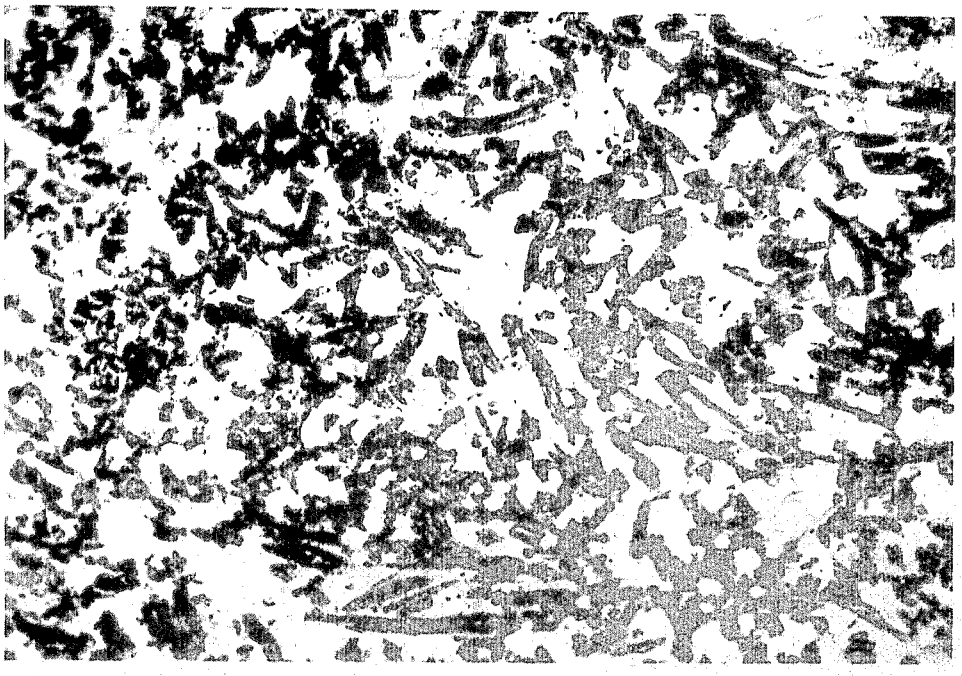

FIG. 3 shows that the compressive strength of materials prepared as described above is substantially the same as the compressive strength of the aluminium alloy itself at temperatures below 200° C. but that above such temperatures there is a substantial increase in compressive strength. Finally, FIG. 4 shows that the hardness of materials prepared as described above is substantially greater than that of the alloy at temperatures above 500° C. Indeed, both specimens prepared as described above exhibit the property of an increase in hardness above about 600° C., right up to temperatures of 1000° C., in contrast with the melting of the aluminium alloy itself at about 540° C. This property is particularly marked in the material prepared as described above and including 20% by volume of zirconia.

Further tests have indicated that the material prepared as described above and including 20% of zirconia may be able to withstand temperatures of 1350° C. to 1400° C. without the aluminium alloy melting out. Although the reasons for this are not fully understood at the present time, it is believed that this may be due to a solid state reaction between the aluminium alloy and the zirconia fibres which appears to commence at temperatures of about 550° C. to 600° C. and may be time related. In this regard, reference is made to FIGS. 5 to 12 which are photo micrographs, at a magnification of 500, of specimens of materials prepared as described above and including 20% by volume of zirconia, at temperatures of 20°, 200°, 350°, 400°, 500°, 550° C., 600°, 850°, and 950° C. respectively. Initial indications are that the reaction leads to the growth of alumina zirconate.

An alternative way of producing the material will now be described.

EXAMPLE 2

An aluminium alloy in accordance with BS1490:1970:LM 13, known as LM 13 is prepared in a molten state at 800° C. A zirconia powder is then stirred into the molten LM 13 aluminium alloy in a quantity to give a required volume proportion which may be between 5 and 50% by volume but is preferably between 10 and 30% by volume, for example 20%. This produces a reaction between the zirconia and the aluminium alloy which forms a pasty material which can be shaped by press forging.

The materials described above with references to Examples 1 and 2 can have properties which can find many industrial uses. For example, they may form blades for gas turbine engines or pistons for internal combustion engines.

I claim:

1. A method of manufacturing a composition of matter comprising:

preparing a melt of a material selected from the group of aluminium or aluminium alloy, incorporating thereinto zirconia in an amount of from 5% to 50% by volume, solidifying the matter so produced, heat treating the solidified matter to produce a solid state reaction between the aluminium or aluminium alloy and the zirconia.

2. A method according to claim 1, wherein the zirconia is in the form of fibres, the method comprising preparing a wad or mat of the zirconia fibres and then infiltrating the wad or mat with molten aluminium or aluminium alloy.

3. A method according to claim 2, wherein the aluminium or aluminium alloy is infiltrated by a squeeze casting process.

4. A method according to claim 1, wherein the zirconia is in the form of a powder, the method comprising incorporating the zirconia powder into the molten aluminium or aluminium alloy.

5. A method according to claim 4, wherein the incorporation is at a temperature of 800° C.

6. A method according to claim 1 and comprising heat treating the solidified matter at a temperature of at least 400° C. and for a time of at least 100 hours.

7. A method according to claim 1 and further including ageing the heat treated solidified matter.

* * * * *